US005229823A

United States Patent [19]

Kalyandurg et al.

[11] Patent Number: 5,229,823

[45] Date of Patent: Jul. 20, 1993

[54] TONER AGITATOR SYSTEM

[75] Inventors: Satyan R. Kalyandurg; Robert J. Ronnenberg, both of Rochester, N.Y.; John M. Fiske, Medford, Mass.

[73] Assignee: Eastman Kodak Company, Rochester, N.Y.

[21] Appl. No.: 828,376

[22] Filed: Jan. 30, 1992

[51] Int. Cl.[5] ..... B05C 11/00

[52] U.S. Cl. ..... 118/612; 355/260; 355/245

[58] Field of Search ..... 118/653, 612; 355/245, 355/260

[56] References Cited

U.S. PATENT DOCUMENTS

| | | | |
|---|---|---|---|
| 2,910,964 | 11/1959 | Stavrakis et al. . | |
| 3,140,199 | 7/1964 | York . | |
| 3,396,700 | 8/1968 | Donalies . | |
| 3,550,555 | 12/1970 | Hudson . | |
| 3,654,900 | 4/1972 | Yang | 118/650 |
| 3,687,106 | 8/1972 | Stange | 118/621 |
| 3,703,157 | 11/1972 | Maksymiak et al. | 118/654 |
| 3,707,389 | 12/1972 | Maksymiak et al. | 117/17.5 |
| 3,848,566 | 11/1974 | Stange | 118/656 |
| 3,870,017 | 3/1975 | Kratcoski et al. | 118/654 |
| 3,941,470 | 3/1976 | Shah | 355/260 |
| 4,150,892 | 4/1979 | Schnall et al. | 118/653 X |
| 4,414,916 | 11/1983 | Martin | 118/612 |
| 4,723,143 | 2/1988 | Enomoto | 355/253 |
| 4,935,783 | 6/1990 | Fujisawa | 355/246 |
| 4,955,316 | 9/1990 | Asanuma et al. | 355/260 X |
| 4,956,668 | 9/1990 | Arnold et al. | 355/245 X |
| 5,012,289 | 4/1991 | Aldrich et al. | 355/260 |
| 5,060,021 | 10/1991 | Yamamoto et al. | 355/245 |
| 5,083,166 | 1/1992 | Hill et al. | 355/260 |
| 5,091,748 | 2/1992 | Morisawa et al. | 355/245 |

*Primary Examiner*—A. T. Grimley
*Assistant Examiner*—Sandra L. Brasé
*Attorney, Agent, or Firm*—D. Peter Hochberg; Mark Kusner

[57] ABSTRACT

A particulate agitator system located within the confines of a particulate sump enclosure comprises two slotted agitator panels, connected together by spaced bars, mounted on a pivot shaft, with one end partially extending from the enclosure. A pivot arm attached to the extending end has a camming surface on its unattached end adapted to periodically engage a pin extending from the side of an adjacent rotating gear. The arm and panels pivot in a first direction during such engagement, while a spring urges the arm and panels in the opposite direction in the absence of engagement, thereby causing the arm to strike an impact pin. The concurrent pivot action of the panels and vibrations of the enclosure when the impact pin is struck cause particles within the enclosure to remain in a free-flowing condition, thereby facilitating removal of the particles from the enclosure by a screw conveyor located at the bottom thereof.

13 Claims, 4 Drawing Sheets

TONER AGITATOR SYSTEM

TECHNICAL FIELD

This invention relates to apparatus useful in the field of document reproduction machines, and more particularly to apparatus particularly adapted to facilitate the handling and transport of toner material in toner dispensing systems employed in electrophotographic copying machines. Specifically, this invention relates to agitating toner powder in toner supply sumps to maintain the powder in a free-flowing condition.

BACKGROUND ART

Electrophotographic-type processes involve a device one of whose components includes a layer of photoconductive insulating material fixed to a conductive backing, termed a "photoconductor". Initially, the surface of the photoconductor is uniformly electrostatically charged over its entire surface, following which it is exposed to a light pattern corresponding to an image to be reproduced. The charge on those surface areas impacted by the light of the image is thereby relatively dissipated, leaving only areas not so impacted in a charged condition. The charge remaining on the surface, therefore, conforms to the configuration of the light pattern reflected from the image to be reproduced.

This latent, electrostatic image can subsequently be "developed" by exposing it to finely divided, electrostatically attractable particulate material. The material is drawn to such surface areas in amounts proportional to the magnitude of the charge in the electrostatically affected areas, thereby forming a temporary image of the material being copied.

The particulate material used to create the temporary image, referred to in the industry as the "toner", typically consists of a pigmented thermoplastic resinous material that can subsequently be transferred to a supporting substrate on which the image of the document being copied is to be permanently fixed. Such a transfer can be accomplished, for example, with the assistance of a corona discharge device that results in the creation of a charge on the substrate, opposite in nature to the charge of the toner forming the temporary image. The temporary toner image is transferred to the substrate by electrostatic attraction occurring when the photoconductor with the image and the substrate are brought into proximity with each other. The transferred image can thereafter be permanently fixed to the substrate by fusing the toner thereto using any of the several known methods.

The process described, depends, however, on the toner being readily available to the charged surface since any deficiencies thereof will result in the charged areas being unable to attract adequate toner. Such an occurrence results in undesirably light images, and therefore in unsatisfactory copies.

Typically, the toner is stored in the copier apparatus in a storage chamber or "toner sump" of a toning station in which the toner is triboelectrically charged in a developer material by mixing. Mixing of the developer material charges and prepares the toner for latent-charge image pickup or removal, as required, thus developing or making such latent image visible. It has been found, however, that the rate of removal of toner from the sump is often erratic and non-uniform. In this regard, and due to their nature and fine particle size, the toner particles have a tendency to pack together, and also to form "bridges", both of which phenomena interfere with the uniform removal of toner from the sump, for example, by a screw conveyor transport system located therein.

In the past, attempts have been made to maintain free flow of the toner material from the sump in a variety of ways, including the use of vibrators attached to the walls of the sump, by various methods of rocking the sump enclosure, by the use of sifting devices, and also through the provision of agitators located within the sump. While some of these expedients have reduced problems of the type referred to, they have been found to entail disadvantages of one kind or another, and non-uniformity of toner withdrawal from the sump has remained a vexing problem.

With respect to agitator devices, for example, they have previously taken the form of wire weldments that are moved within the sump area in an effort to retain the toner particles in a free-flowing condition. Unfortunately, wire forms are often unable to resist the flexing stresses imposed on them during agitation. Furthermore, they have frequently not been able to withstand the bending stresses typically experienced, and are incapable of always successfully resisting the destructive shock forces to which they are continually subjected.

SUMMARY OF THE INVENTION

In view of the preceding, therefore, it is a first aspect of the invention to provide a system for facilitating the removal of toner particles from sumps that can be used in apparatus including electrophotographic machines, copiers, duplicators and other equivalent devices.

It is a second aspect of this invention to provide a system for maintaining toner particles in a copying apparatus in a free-flowing condition.

Another aspect of this invention is to provide an agitator system for a toner sump enclosure.

An additional aspect of this invention is to provide an agitator system for a toner sump enclosure employed in copying apparatus that does not rely on wire form agitators to agitate the toner therein.

A further aspect of this invention is to provide a system for maintaining toner in a sump enclosure holding the same in a free-flowing condition by concurrently agitating the toner and applying shock-produced vibrational forces to the walls of the sump.

A still further aspect of this invention is to provide an agitator for a toner sump enclosure formed from a strong, force-resistant material such as, for example, sheet metal.

Yet another aspect of this invention is to provide a more efficient, lower cost, more wear-resistant agitator system for a toner sump enclosure that accomplishes the removal of toner particles from the sump by means of a screw conveyor located at the bottom thereof.

The invention in its preferred form includes an agitator system for a copying apparatus. The agitator system comprises a plurality of spaced-apart agitator panels or walls, oriented tangentially to the rotation giving least resistance to the agitator. The panels or walls are located within a sump enclosure or housing and are connected to an external pivot shaft extending into the enclosure. The shaft includes impact means such as a pivot arm attached to the extending portion of the shaft, positioned at right angles thereto. The pivot arm is provided with a camming surface at its unattached end. The device further includes torque means which is preferably a driven gear having a pin extending from a side thereof adapted to engage the camming surface during a portion of each revolution of the gear, causing the shaft to pivot in first direction. Return force means such as spring means connected to the shaft then urges the shaft to pivot in the opposite direction when the pin moves beyond the camming surface, thereby bringing the arm into forceful impact contact with stop means such as an impact pin connected to the sump enclosure. The combined pivot motion of the agitator panels and the high impact frequency vibration caused by the spring stop results in unimpaired flow of the toner particles within the sump.

The agitator device of the preferred form of the invention for a toner sump forming part of a copying apparatus, further comprises a plurality of spaced-apart parallel agitator panels connected by spacer bars all mounted on a pivot shaft.

The preceding and additional aspects of the invention are provided by a copying device which includes an agitator system according to the preceding paragraphs.

BRIEF DESCRIPTION OF THE DRAWINGS

The invention will be better understood when reference is had to the following Figures, in which like-numbers refer to like-parts, and in which.

BEST MODE FOR CARRYING OUT THE INVENTION

Figure 1:
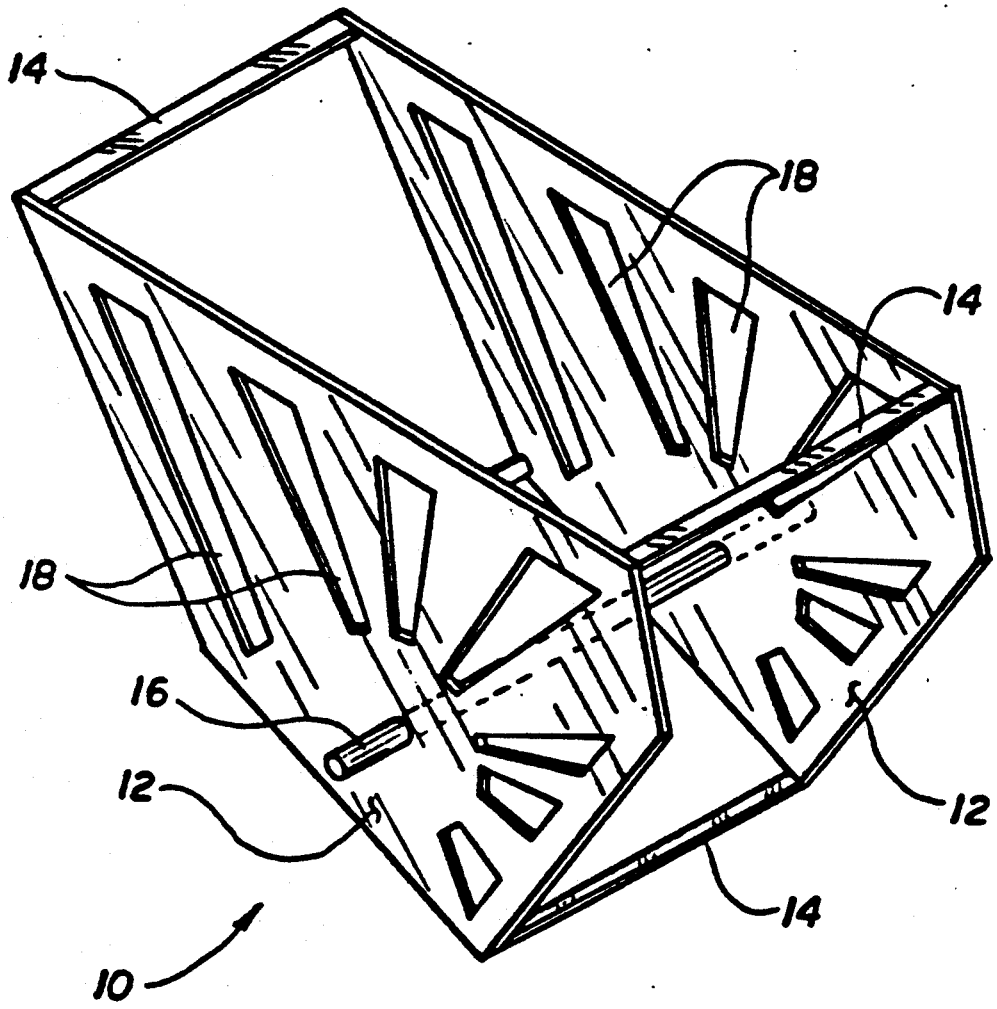
FIG. 1 is an isometric view of an agitator assembly of the invention.

FIG. 1 is an isometric view of an agitator assembly of the invention, generally 10. As shown, the agitator assembly consists of two agitator panels 12, connected by spacer bars 14. The assembly also includes a pivot shaft 16, about which panels 12 are designed to pivot. Each of the panels 12 also includes mixing slots 18, generally radiating from pivot shaft 16.

Figure 2:
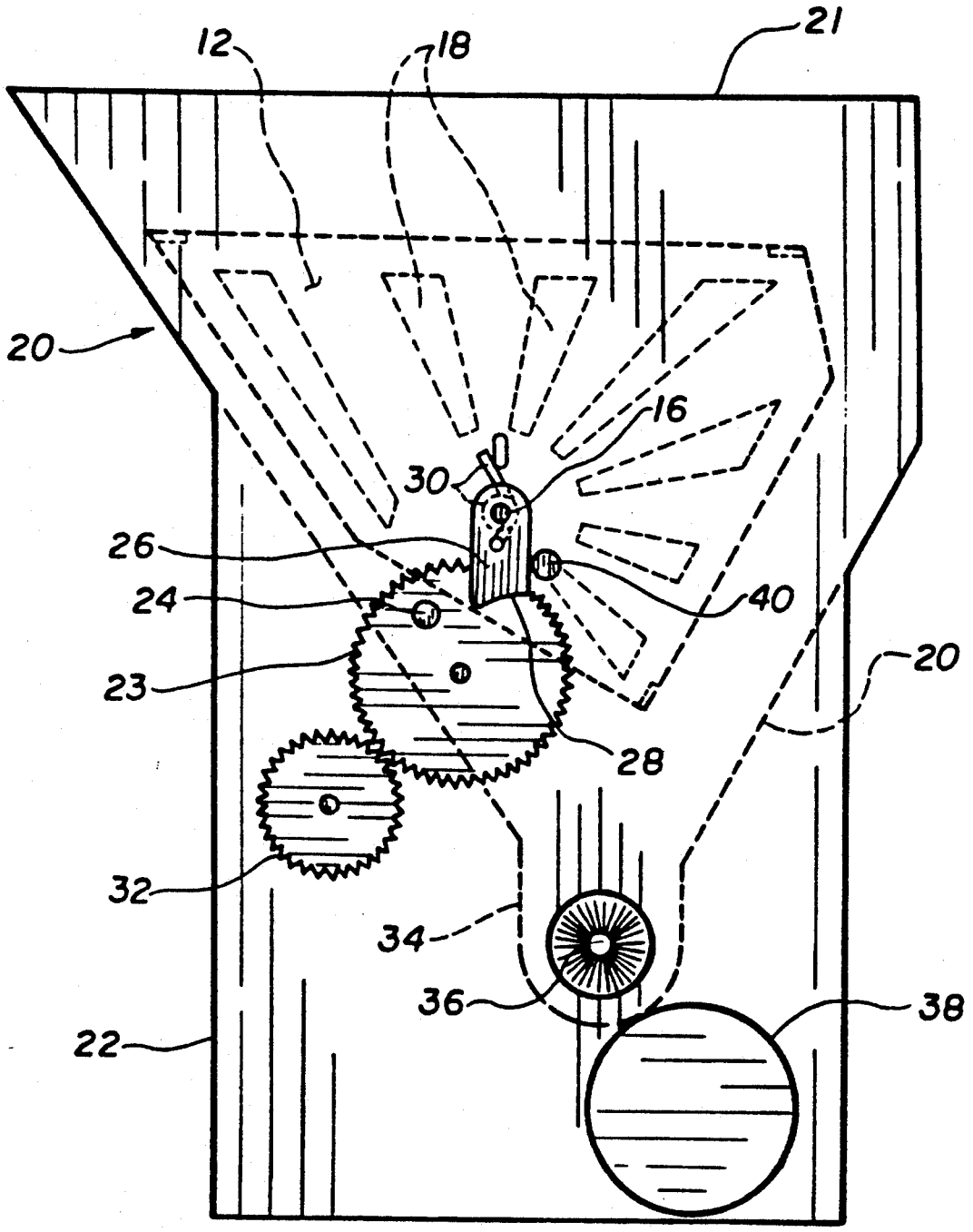
FIG. 2 is a side elevation of a toner storage and transportation assembly which includes the toner agitator system of the invention, in a cam-disengaged position.

While not essential to operability of agitator assembly 10, the slots constitute a preferred embodiment since they assist in the agitating action performed by the pivoting motion of the assembly, which also serves to force the toner particles into the lower portions of the sump, better seen in FIG. 2, where the particles are able to be withdrawn from the sump.

While other slot configurations are useful in the invention, quadrilateral slots radiating from the pivot shaft 16 at intervals of about 10° to 20° have been found to provide superior results in this regard.

FIG. 2 is a side elevation of a toner storage and transportation assembly which includes the toner agitator system of the invention, in a cam-disengaged position. As illustrated, agitator cam assembly 10 is shown mounted in a sump assembly 20. The agitator cam assembly has a screw 36 formed by bristles 37 arranged in a helical pattern that extends from a central core which can include a pair of intertwined wires from which the bristles can extend, positioned in a conveyor trough 34 located near the bottom of the assembly. A drive motor 38 is provided which by means not shown drives screw 36 to discharge toner particles from sump assembly 20. Motor 38 also drives gear 32 through a gear train, likewise not shown, drive gear 32 engaging and driving gear 23. As gear 23 rotates, a pin 24 extending from the side thereof comes into contact with camming surface 28, located on pivot arm 26, the latter in turn being connected to, and rotatable with, pivot shaft 16 attached to agitator assembly 10.

Movement of pin 24 against camming surface 28 causes pivot arm 26 to rotate pivot shaft 16, and the agitator system 10 attached thereto to pivots with pivot shaft 16. Thereafter, when pin 24 disengages from camming surface 28 as driven gear 23 continues to rotate, pivot arm 26 is urged by spring 30 into forceful contact with impact pin 40, thereby liberating the toner particles from their electrostatic tendency to cling to the walls of the sump and the agitator assembly. A housing 22 encloses portions of the connecting gearing referred to, but not shown, as well as other parts of the apparatus. Spring 30 is preferably a coil spring would about pivot shaft 16 and having a turned leg extending through hole in pivot arm 26 and its other leg bearing on a post on housing 22.

As shown in the Figure, pivot arm 26 is in a cam disengaged position. Pin 24 is not engaged with camming surface 28 and spring 30 has pivoted arm 26, pivot shaft 16 and agitator assembly 10 to pivot counter clockwise, with arm 26 in engagement with impact pin 40.

Figure 4:
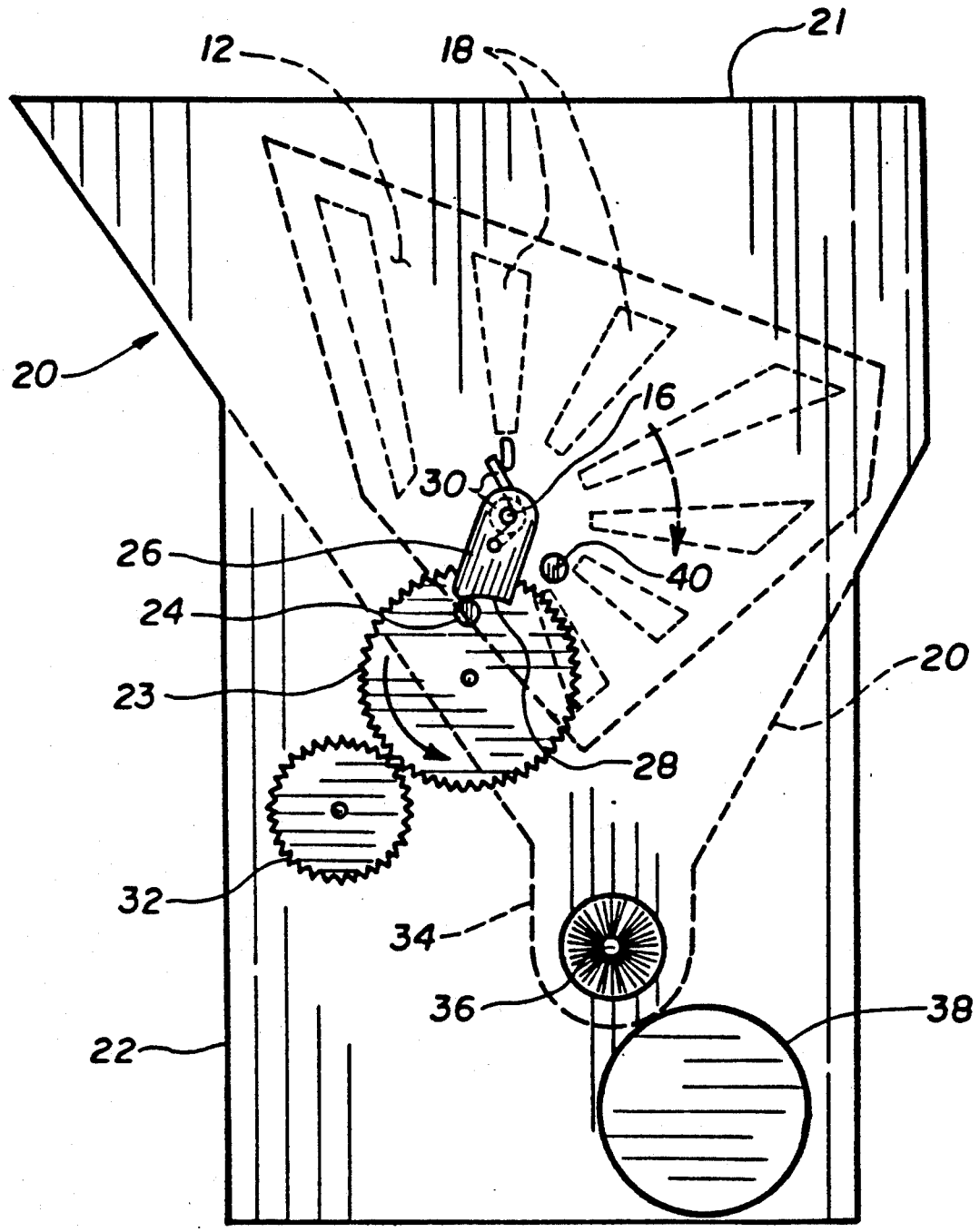
FIG. 4 is a side elevation of a toner storage and transportation assembly which includes the toner agitator system of the invention, in a cam-engaged position.

Action of the mechanism resulting in pivoting of the agitator assembly clockwise in the Figures is shown in FIG. 4, described below. Both the action of the agitator panels 12 back and forth, together with the simultaneous high frequency and high magnitude vibrations resulting from impact of pivot arm 26 with impact pin 40 are required to cause movement of the toner particles sufficient to maintain them in a satisfactorily free-flowing condition, while the mixing slots 18, together with the action of gravity, aid in forcing the toner particles into conveyor trough 34, where they are removed from the sump by the action of screw 36.

Figure 3:
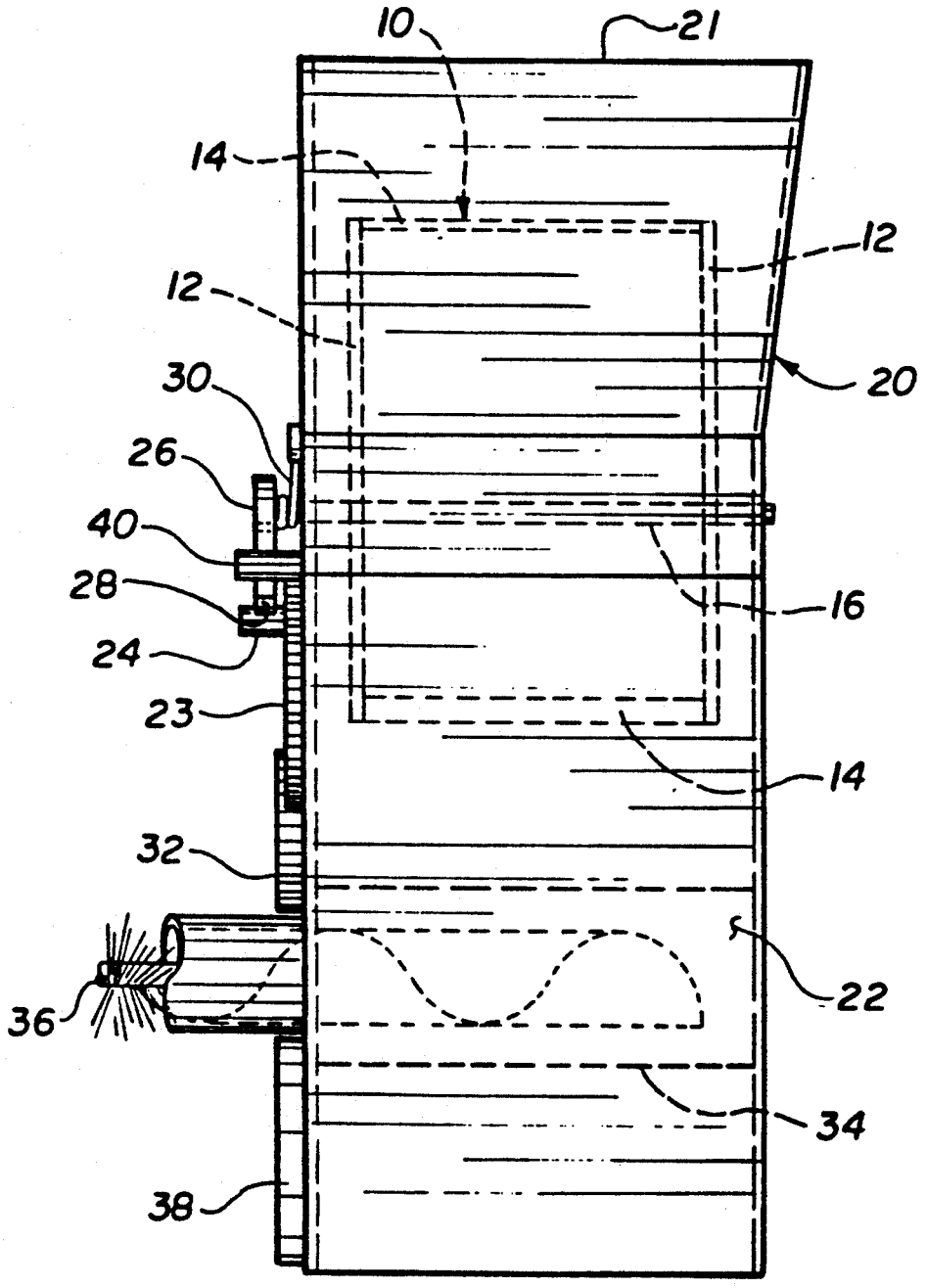
FIG. 3 is an end elevation of the assembly of FIG. 2.

FIG. 3 is an end elevation of the assembly of FIG. 2. The Figure shows agitator assembly 10 with its parallel agitator panels 12, connected by spacer bars 14, mounted on pivot shaft 16, the whole being located within the confines of sump assembly 20, the open end 21 of which provides a sump entry point for introduction for the toner particles. A portion of pivot shaft 16 extends beyond sump assembly 20, upon which pivot arm 26 mounted. Spring 30, mounted on pivot shaft 16, serves to urge the agitator assembly 10 to pivot with shaft 16 moving counterclockwise when viewed from the right when the camming surface 28 of the pivot arm is not in contact with pin 24 on gear 23, so that pivot arm 26 strikes impact pin 40.

Also shown is a conveyor trough 34 at the bottom of the sump assembly 20 with a brush screw 36, driven by drive motor 38 located therein. Gear 23 and some of the associated gearing, not shown, drives the working parts of the mechanism.

FIG. 4 is a side elevation of a toner storage and transportation assembly which includes the toner agitator system of the invention, in a cam-engaged position. The Figure illustrates sump assembly 20 with agitator panels 12 located therein connected to pivot shaft 16 that is attached to pivot arm 26. Gear 23, driven counterclockwise (as shown by the solid arrow) by drive gear 32 and having pin 24 extending from the side thereof, is adapted to engage camming surface 28 of pivot arm 26, forcing agitator assembly 10 to pivot clockwise, in the direction of the dotted arrow. In that position, pivot arm 26 is moved away from impact pin 40, whose use has been previously described. Drive motor 38 rotates gear 32, as well as brush screw 36 by a gear train, not shown. Pivoting of the agitator panels promotes loosening of the toner particles introduced into the sump assembly 20 through sump entry 21, while the mixing slots 18, assisted by gravity, propel the toner particles downward and into contact with the brush screw conveyor 36, located in conveyor trough 34.

The frequency of the pivot cycle, i.e., the back and forth motion of the agitator panels 12 is not critical, and may be varied within a fairly broad range, for example, from between about 5 to about 100 cycles per minute. However, the frequency should be controlled below that at which sufficient friction is generated to heat the thermoplastic resin to a point at which it reaches its softening point.

The dimensions of the agitator assembly, and other components of the toner agitator system of the invention will depend upon the particular application and dimensions of the device with which it is used. Within such considerations, however, and in a sump assembly enclosure having a width of about 3½ inches across, about 2½ inches wide, and approximately 6 inches deep, the agitator panels will be about 3½ inches across and about 3½ inches long. The panels will be shaped to accommodate their pivoting motion within the sump assembly, and may be pentagonally shaped as shown in the Figures, the angles being selected to accommodate the pivoting motion referred to.

In such a toner agitator system, the pivot arm will be about 1 inch long and about ¾ inch wide, while the screw conveyor will have a diameter of about ½ inch. In view of the stresses to which the agitator panels 12 are subjected, they will desirably be made from a relatively strong material, for example, low carbon steel. While the agitator panels may have a different thickness, the use of panels fabricated from sheet metal having a thickness of from about 1/32 to about 1/16 has been found to be satisfactory.

While emphasis has been placed on copying devices, particularly those of the electrophotographic type, the agitator system disclosed and described has application to other systems where it is necessary to maintain particulate materials in free-flowing condition including, but not limited to copiers, printers, duplicators and the like.

While in accordance with the patent statutes, a preferred embodiment and best mode has been presented, the scope of the invention is not limited thereto, but rather is measured by the scope of the attached claims.

We claim:

1. A toner agitator system for agitating particulate toner to facilitate flow of the toner, said system comprising:

agitator means movable through particulate toner, said agitator means including sheet material which is substantially rigid as it moves through the toner;

drive means for moving said agitator means through the toner; and spring powered impact means for transmitting impacting forces to said agitator means to vibrate toner on the agitator.

2. A toner agitator system according to claim 1, wherein said agitator means comprises:

a pair of opposing, spaced walls made of said sheet material; and spacer means for supporting said walls in their opposing, spaced relationship.

3. A toner agitator system according to claim 1 wherein said agitator means is fixed on a rotatable pivot means, and said agitator means rotates with the rotation of said pivot means.

4. A toner agitator system according to claim 3, wherein said pivot means is a pivot shaft.

5. A toner agitator system according to claim 1 wherein said sheet material is sheet metal.

6. A toner agitator system for agitating particulate toner to facilitate flow of the toner, said system comprising:

agitator means movable through particulate toner, said agitator means including sheet material which is substantially rigid as it moves through the toner;

drive means for moving said agitator means through the toner; and impact means for transmitting impacting forces to said agitator means to vibrate the toner, wherein said agitator means comprises:

interconnected walls of said sheet material, said walls including surfaces defining apertures in said walls, said surfaces agitating the toner as said agitator means moves through the toner.

7. A toner agitator system for agitating particulate toner contained in a sump housing to facilitate flow of the toner, said system comprising:

agitator means movable through particulate toner, said agitator means including sheet material which is substantially rigid as it moves through the toner;

drive means for moving said agitator means through the toner;

stop means connected to said sump housing; and impact means for transmitting impacting forces to said agitator means to vibrate the toner, and rotatable pivot means for moving said agitator means, wherein said impact means comprises an impact arm mounted on said pivot means, said impact arm being pivotable to move said agitator means and being subject to a return force for moving said impact arm against said stop means to apply an impact force to said agitator means.

8. A toner agitator system for agitating particulate toner contain in a sump housing to facilitate flow of the toner, said system comprising:

agitator means movable through particulate toner, said agitator means including sheet material which is substantially rigid as it moves through the toner;

drive means for moving said agitator means through the toner;

stop means connected to said sump housing;

impact means for transmitting impacting forces to said agitator means to vibrate the toner; and further comprising rotatable pivot means for moving said agitator means, and wherein said impact means comprises an impact arm mounted on said pivot means, said impact arm being pivotable to move said agitator means and subject to a return force for moving said impact arm against said stop means to apply impact force to said agitator means, and wherein further said pivot means is a pivot shaft for rotating said agitator means in the toner, said impact arm is mounted on said pivot shaft and includes cam surfaces which when engaged by torque means transfers sufficient torque to said pivot shaft to rotate said pivot shaft, and when disengaged from the torque means the spring return force drives said impact arm into said stop means.

9. A sump system for supplying toner in electrostatic reproduction machines, said sump system comprising:

a sump housing having an interior section for holding supplies of electrostatic, particulate toner, said sump housing having a toner input section and a toner exit section;

agitator means movably mounted in the interior section of said sump means, said agitator means including walls of rigid sheet material;

pivot shaft means operatively connected to said agitator means and rotatable for pivoting said agitator means;

impact arm means operatively connected to said pivot shaft means, and rotatable upon the application of torque forces to said arm means for rotating said pivot shaft means;

stop means in the path of said impact arm means;

return force means for urging said impact means against said stop means;

torque means movable for urging said impact arm means away from said stop means as toner is urged out of said interior section, said torque means intermitently urging said torque means away from said stop means, and said return force means intermitently urges said impact arm means against said stop means with sufficient impact force to facilitate the flow of the toner, the intermitent operation of said torque means and said return force means being done in an alternate relationship.

10. A sump system according to claim 9 and further comprising rotatable screw brush means extending in said exit section for rotating and driving toner from said housing.

11. A sump system according to claim 9 wherein said agitator means comprises a pair of opposing spaced walls made of said sheet material, and spacer means for supporting said walls in their opposing, spaced relationship.

12. A sump system according to claim 9 wherein said torque means comprises rotatable gear means rotatably mounted on said housing, said gear means including impact arm drive means engageable with said impact arm means through part of the rotation of said gear means for rotating said impact arm means to rotate said pivot shaft means and said agitator means; and said return force means comprises spring means for urging said impact arm means towards said stop means;

said gear means rotating to rotate said impact arm means through a certain angular distance and then releasing said impact arm means, and said spring means moving said impact arm means against said stop means to impart an impact force to said agitator means to facilitate the flow of the toner.

13. A sump system according to claim 9 wherein said walls are made of sheet metal.

* * * * *